US005102250A

United States Patent [19]

Gueret

[11] Patent Number: 5,102,250

[45] Date of Patent: Apr. 7, 1992

[54] MAKE-UP UNIT WITH A SOLVENT RETENTION MEMBER

[75] Inventor: Jean-Louis Gueret, Paris, France

[73] Assignee: L'Oreal, Paris, France

[21] Appl. No.: 538,327

[22] Filed: Jun. 15, 1990

[30] Foreign Application Priority Data

Jun. 23, 1989 [FR] France ..... 89 08396

[51] Int. Cl.[5] ..... A45D 40/00; A45D 40/26

[52] U.S. Cl. ..... 401/126; 401/129; 401/130

[58] Field of Search ..... 401/126, 129, 130

[56] References Cited

U.S. PATENT DOCUMENTS 813,813 2/1906 Munroe ..... 401/129

FOREIGN PATENT DOCUMENTS 458837 5/1945 Belgium .
560049 8/1957 Belgium ..... 401/130
0163323 5/1985 European Pat. Off. .
0237487 4/1987 European Pat. Off. .
66343 6/1956 France ..... 401/129
2290863 7/1976 France ..... 401/129
2412287 8/1979 France ..... 401/129
403182 6/1966 Switzerland ..... 401/129
20655 of 1902 United Kingdom ..... 401/129
1265503 3/1972 United Kingdom ..... 401/129

*Primary Examiner*—Steven A. Bratlie

[57] ABSTRACT

The make-up unit (1) comprises a container (3) for the fluid product (M) and a cap (2) bearing a stick (4) provided with an application organ (5) which plunges into the fluid product (M) when the unit (1) is in closed position. The container (3) contains a retention member (10) which is in contact with the fluid product (M) and contains a cosmetically acceptable dissolvent capable of fluidifying said fluid product (M). The retention member (10) releases the cosmetically acceptable dissolvent during the storage in order to re-fluidity the product (M) as it dries.

11 Claims, 1 Drawing Sheet

MAKE-UP UNIT WITH A SOLVENT RETENTION MEMBER

This invention relates to a make-up unit implementing a fluid make-up product capable of hardening by evaporation of a solvent, viz. a make-up unit implementing a mascara.

In a known way, a make-up unit implementing a fluid product comprises a fluid make-up product container and a cap closing the container, and bearing, at the end of a stick, an organ for the application of said fluid make-up product. The stick is held within the container when the make-up unit is closed, in order to plunge the application organ into the fluid product. In a known way, the application organ may consist of a pencil, a cylindrical or conical bottle-brush type brush, a flexible and slender, conically or cylindrically-conically shaped member, generally called "feather", having or not having a flocked surface, or a foam or felt tip.

Some plastic materials, such as polyesters, used to manufacture the container have a non-negligible permeability to some solvents of the fluid product. As a consequence, the solvents has a tendency to evaporate or escape through the walls of the container during storage. Thus, the fluid product has a tendency to harden during storage and, after some storage time, can no longer be satisfactorily used by means of the application organ. Moreover, the drying may cause a deterioration of the fluid product. This problem is particularly important in the case of mascara, for it contains only a very small quantity of solvent, this solvent most often being water: the mascara contains, e.g., between 5 and 15 weight-%.

In order to cope with this disadvantage, it has been thought to use polyethylenes which have better permeability characteristics, particularly to water; but these plastic materials make the container look less attractive. Other plastic materials can also be used but they are expensive and highly burden the cost of the make-up unit.

It has already been proposed, in the documents EP-A 0 237 487 and DE-A 3 520 523, to insert in the cap of the make-up unit a pad which is into contact with the application organ and contains a liquid capable of moistening or cleaning said application organ. Thus, the hardening of the application organ is dealt with, but not the drying of the product mass inside the container.

BE-A-458837 discloses avoidance of the drying of a product contained in a vessel by using an evaporation chamber containing a solvent, which allows, saturation of the air contained in the vessel with solvent when the vessel is closed. Thus, one avoids the problem of the balance of the vapour pressures inside the vessel being detrimental to the product contained in the vessel.

EP-A-0 163 323 relates to an application unit for mascara, comprising, at the bottom of the part containing the mascara, a chamber provided with drying lips. The chamber may be filled with the same cosmetic as the rest of the container or with another substance (cleaning agent and/or disinfectant), or, simply, with air. The mascara brush can enter the chamber in order to be cleaned or loaded with an aseptic liquid. Furthermore, the action of the drying lips during the in and out movements of the brush avoids the build up of a mascara crust on the brush.

According to this invention, in order to avoid the drying of the fluid liquid product contained in the container of the make-up unit, said product is brought into contact, in the container, with a solvent loaded retention member capable of releasing this solvent in the course of time, in order to re-fluidify the make-up product as it dries.

This invention thus relates to a make-up unit implementing a fluid make-up product capable of hardening by evaporation of a solvent unit. This comprises a container to contain said fluid product and a cap bearing a stick provided with an application organ penetrating into the container, so that, in closed position of the make-up unit, the application organ is plunged into the fluid product container. The contains a retention member which is in contact with the fluid product and contains a cosmetically acceptable solvent capable of wetting said fluid product and that the retention member be arranged in the container, between the bottom of same and the application organ.

The retention member is advantageously cylindrically shaped. It may also be completely or partly passed through by a conical or cylindrical recess and, in this case, the application organ is preferably at least partially arranged inside the retention member.

The retention member may be directly inserted in the bottom of the container; in this case, it advantageously has an external shape complementary to that of the bottom of the container, in order to be maintained in it by mere friction. However, other fixing methods can be envisaged: it may, e.g., be contained in an hollow plug adaptable, viz. by screwing-in or clipping-in, onto the bottom of the container; in these circumstances, it is possible to exchange or re-load the retention member with a cosmetically acceptable solvent when it is too dry to be capable of releasing solvent into the fluid product.

According to a preferred embodiment, a solvent flow regulating filter is arranged between the retention member and the end of the application organ. The filter is, in particular, comprised of a screen made of a polyamid such as the one corresponding to the trade name of "Nylon". This filter can be fixed onto a ring which is inserted into the container. It is also possible to fix it directly onto the retention member, by peripheral gluing or by means of a circlip. When the retention member is contained in a hollow plug, the filter is preferably fixed onto said plug by means of a ring or by gluing.

According to a first variant of the invention, the retention member is made of any material capable of absorbing a solvent. It may be made of a solid porous material, such as a cellulose pad, a natural or synthetical sponge, a porous stone, a porous ceramic material or a porous plastic material. It may also be made of a semi-rigid aqueous gel which has no tendency to flow in the container. In this latter case, the retention member is preferably prepared directly in the container by introducing into same an aqueous solution containing the gellifying agent and by modifying the conditions, e.g., of the pH, to cause the forming of the gel. The gellifying agent is, e.g., carboxymethylcellulose or a product sold under the trade-name of "CARBOPO" by GOODRICH B. F. Chemical Company. According to a second variant of the invention, the retention member is a container closed by means of a semi-pervious diaphragm, whereby the solvent contained in the container can pass through the semi-permeable diaphragm only in the form of vapour.

The solvent of the fluid make-up product and the cosmetically acceptable solvent introduced into the retention material may be different, but are preferably identical, so as not to modify the properties of the fluid make-up product. It is obvious that the cosmetically acceptable solvent depends on the nature of the fluid make-up product and that any cosmetically acceptable solvent allowing to wet the make-up product can be used.

In the case the fluid product is a mascara, the cosmetically acceptable solvent is most often water. It may however also be comprised of a polar solvent, more particularly polyethylene glycol.

When the retention member is made of a porous solid material, the cosmetically acceptable solvent may also be gellified; it may, e.g., be gellified in the porous solid material by loading this material with a solvent containing the gellifying agent and by modifying the conditions to form the gel in situ. The embodiment used depends on the porous solid material used.

It is advantageous, in some cases, to introduce, in the cosmetically acceptable solvent contained in the retention member, at least a cosmetically acceptable additive, such as a conservation agent. Thus, it is prevented from being introduced into the fluid make-up product, which is advantageous in case it would have a noxious effect onto the make-up product after a too long period of contact.

In order for the object of the invention to be better understood, two embodiments shown in the attached drawing will be described below, merely as an illustration and without the invention being limited thereto.

Figure 1:
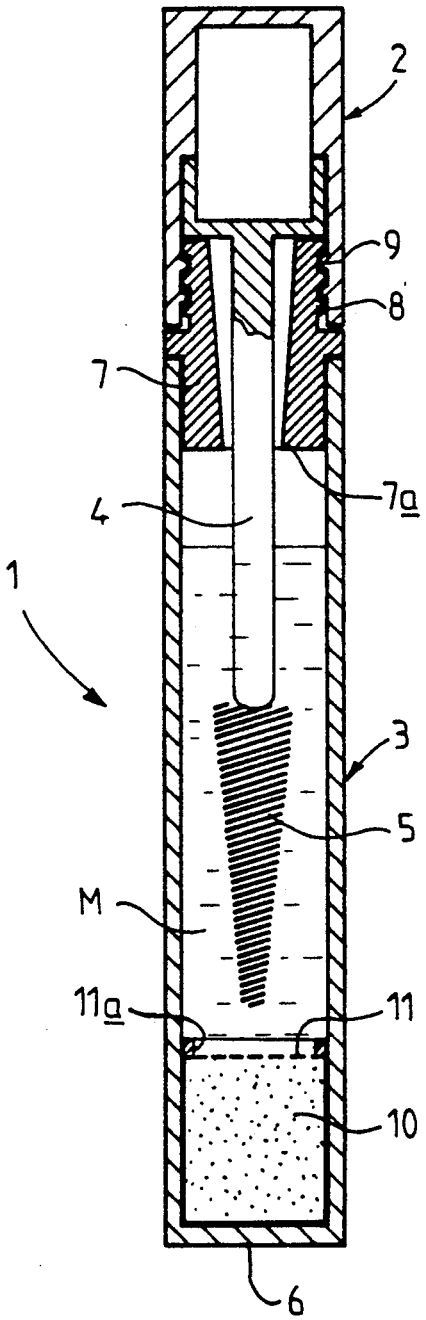
FIG. 1 is a longitudinal cross-sectional view of a first embodiment of a make-up unit according to the invention implementing a mascara.

The make-up unit shown in FIG. 1 implements a mascara and is designated by 1 in its whole; it has an elongated cylindrical general shape and comprises a cap 2 and a container 3. Inside the cap 2 is fixed, by fitting, a stick 4 which bears, according to the embodiment shown, a brush 5 at its end opposite to the end at which it is fixed to the cap. The container 3 is closed at its one end by a bottom 6 and is open at the opposite end. Into the open end of the container 3 is fixed, by forced fitting, a dryer 7, a part of which is plunged into the container 3 and bears the drying lips 7*a*; the other part of the dryer is arranged outside the container 3 and bears, on its outer wall, an external thread 8 which co-operates with an internal thread 9 of the cap 2.

At the bottom 6 of the container is arranged a porous solid retention member 10 which has a cylindrical shape. This member 10 is comprised of a pad made of a water-loaded cellulose material. In the proximity of the surface of the retention member 10, between said surface and the brush 5, has been arranged, inside the container 3, a filter 11 mounted onto a ring 11*a*; the filter 11 is comprised of a thin nylon screen. The container 3 is filled with mascara M. Thus, it is seen that the mascara enters into contact, through the filter 11, with the retention member 10 which is loaded with water.

During the storage, the mascara dries, because part of the water it contains passes through the walls of the container 3 and, eventually, also part of the solvent has evaporated during the opening of the unit to use the mascara. In order to compensate for this evaporation and the drying of the mascara, part of the water contained in the retention member 10 migrates into the mascara M, through the filter 11, and gives the mascara M again an appropriate fluidity in order to be used by means of the brush 5.

To assemble the make-up unit 1, the porous member 10 is inserted into the container 3 and previously loaded with water. Afterwards, the ring 11*a* bearing the filter 11 is inserted, then mascara is poured into the container 3. Finally, the dryer 7 is fixed at the open end of the container 3 and the cap bearing the stick 4 and the brush 5 is screwed on.

Figure 2:
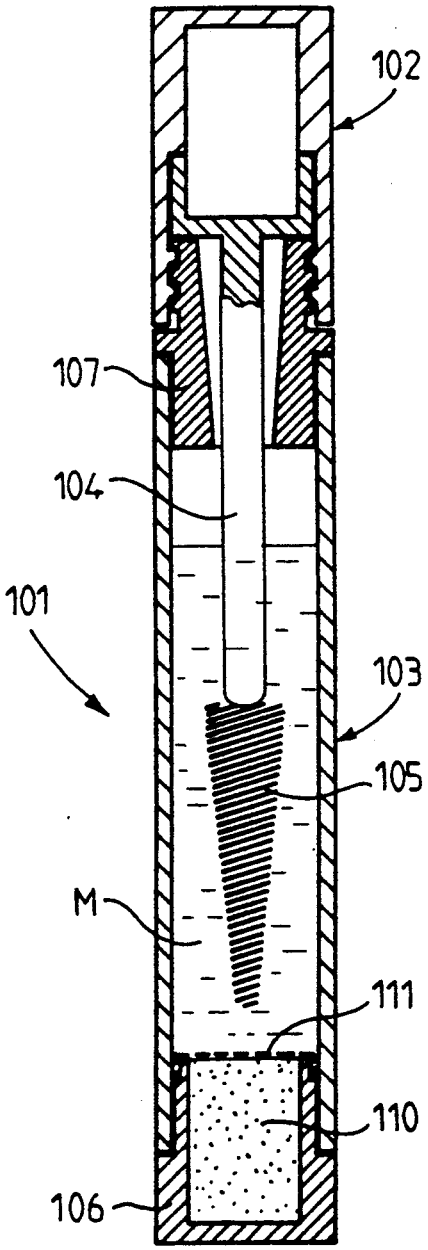
FIG. 2 is a longitudinal cross-sectional view of a second embodiment of a make-up unit according to the invention implementing a mascara.

FIG. 2 shows a second embodiment of a make-up unit for mascara according to the invention. The components which are analogous or have a function similar to those described with regard to FIG. 1 will be designated by reference numerals equal to the sum of the number 100 and the reference numeral used for the corresponding component in FIG. 1; their description will not be given or will be made briefly. In the make-up unit 101 shown in FIG. 2, the retention member 110 is contained in a hollow plug 106 which is forcedly inserted into the container 103 at the end opposite to the cap 102, so as to form the bottom of the container 103. The filter 111 is fixed onto the side-wall of the plug 106, at the end of said plug which is inside the container; in this way, it is stretched in the proximity of the surface of the retention member 110 which is contained in the hollow plug 106.

To assemble the make-up unit 101, the plug 106 containing the water-loaded retention member 110 and bearing the filter 111 is inserted at the end of the container 103 and the container 103 is filled with mascara M. Afterwards, the dryer 107 is placed, then it is closed by means of the cap 102 which bears the stick 104 and the brush 105.

When the member of porous material 110 no longer contains sufficient cosmetically acceptable solvent to compensate for the evaporation of the solvent from the mascara, the plug 106 can be removed and then one can either replace it on the container by a new plug 106 containing a new solvent loaded retention member 110 or replace the retention member 110 in the plug by a new, solvent-loaded retention member, or even simply load the retention member 110 contained in the plug 106 with solvent. In this latter case, when the solvent used is water, as is often the case for mascara, it is very easy for the user of the make-up unit to saturate the retention member as often as he so wishes.

I claim:

1. Make-up unit (1, 101) implementing a fluid make-up product capable of hardening by evaporation of a solvent, said unit comprising a container (3, 103) to contain said fluid product and a cap (2, 102) bearing a stick (4, 104) provided with an application organ (5, 105) penetrating into the container (3, 103), so that, in closed position of the make-up unit, the application organ (5, 105) is plunged into the fluid product, characterized in that the container (3, 103) contains a retention member (10, 110) which is in contact with the fluid product (M) and contains a cosmetically acceptable solvent capable of wetting said fluid product and that the retention member is arranged in the container (3, 103), between the bottom of same and the application organ (5, 105).

2. Unit according to claim 1, characterized in that the retention member (110) is contained in an adaptable cover (106) so as to form the bottom of the container (103).

3. Unit according to either of claims 1 or 2, characterized in that a solvent flow regulating filter (11, 111) is arranged between the retention member (10, 110) and the end of the application organ (5, 105).

4. Unit according to claim 3, characterized in that the filter (11, 111) is comprised of a polyamid screen.

5. Unit according to claim 1, characterized in that the retention member (10, 110) is made of a solid porous material.

6. Unit according to claim 1, characterized in that the retention member (10, 110) is a container closed by means of a semi-permeable diaphragm, whereby the solvent contained in the container can pass through the semi-permeable diaphragm only in the form of vapour.

7. Unit according to claim 1, characterized in that the fluid product is a mascara and that the cosmetically acceptable solvent is water.

8. Unit according to claim 7, characterized in that the cosmetically acceptable solvent is gellified.

9. Unit according to claim 1, characterized in that the retention member (10, 110) is made of a semi-rigid gel.

10. Unit according to claim 1, characterized in that the fluid product is a mascara and that the cosmetically acceptable solvent is a polar solvent.

11. Unit according to claim 10, characterized in that the polar solvent is polyethylene glycol.

* * * * *